United States Patent [19]

Bauer et al.

[11] Patent Number: 4,777,893

[45] Date of Patent: Oct. 18, 1988

[54] PRESSER FOOT ASSEMBLY

[75] Inventors: Helmut Bauer, Stuttgart; Helmut Durr, Heimsheim; Milan Petrovic, Hemmingen, all of Fed. Rep. of Germany

[73] Assignee: Union Special G.m.b.H., Stuttgart, Fed. Rep. of Germany

[21] Appl. No.: 8,501

[22] Filed: Jan. 29, 1987

[30] Foreign Application Priority Data

Feb. 5, 1986 [DE] Fed. Rep. of Germany ..... 3603506

[51] Int. Cl.[4] ..... D05B 29/08

[52] U.S. Cl. ..... 112/235

[58] Field of Search ..... 112/60, 235, 236, 237, 112/240

[56] References Cited

U.S. PATENT DOCUMENTS

| | | | |
|---|---|---|---|
| 1,267,621 | 5/1918 | Berger | 112/235 |
| 1,893,582 | 1/1933 | Fine | 112/235 X |
| 2,147,128 | 1/1939 | Sailer | 112/235 |
| 2,288,404 | 6/1942 | Kahre | 112/235 |
| 2,298,770 | 10/1942 | Kucera | 112/235 |
| 2,741,200 | 4/1956 | Smith | 112/235 |

FOREIGN PATENT DOCUMENTS

| | | | |
|---|---|---|---|
| 3410181 | 10/1985 | Fed. Rep. of Germany | 112/235 |
| 369514 | 3/1939 | Italy | 112/236 |

*Primary Examiner*—Wm. Carter Reynolds
*Attorney, Agent, or Firm*—Powell L. Sprunger

[57] ABSTRACT

A presser foot assembly for use with a workpiece support in a sewing machine having a sole plate, a body for supporting the sole plate in a position for pressing material to be sewn onto a workpiece support, and a lead-in sole part. The assembly has a pin for pivotally connecting the lead-in sole part to the sole plate, and a spring for moving the lead-in sole part between a first position adjacent the workpiece support and a second position spaced from the workpiece support.

12 Claims, 2 Drawing Sheets

PRESSER FOOT ASSEMBLY

BACKGROUND OF THE INVENTION

The present invention relates to presser foot assemblies for sewing machines.

Presser foot assemblies for pressing material to be sewn onto a workpiece support are known. For these presser foot assemblies, however, there exists the disadvantage that it is either difficult, or impossible, to position accurately, at a predetermined distance from the needle of the sewing machine, the start of material to be sewn. Accurate positioning is particularly necessary in cases where a predetermined thread is to begin or end at a predetermined point.

SUMMARY OF THE PRESENT INVENTION

A principal feature of the present invention is the provision of an improved presser foot assembly.

The presser foot assembly of the present invention comprises, a sole plate, means for supporting the sole plate in a position for pressing material to be sewn onto a workpiece support, and a lead-in sole part.

A feature of the present invention is the provision of means for pivotally connecting the lead-in sole part to the sole plate.

A further feature of the invention is the provision of means for moving the lead-in sole part between a first position adjacent the workpiece support and a second position spaced from the workpiece support.

A feature of the present invention is that the assembly makes it possible to accurately position the start of material to be sewn.

Another feature of the invention is that the sole plate has a front face which extends transversely to the direction of sewing and which is uncovered when the lead-in sole part is pivotally lifted.

A further feature of the invention is that the front face serves as a locating stop face for engagement by a leading edge of the material to be sewn, such that the start of material can be accurately positioned and satisfactorily fixed when the lead-in sole part is lowered.

The moving means includes a spring element connected between the supporting means and the lead-in sole part.

A further feature of the invention is that the spring element urges the lead-in sole part towards the workpiece support means when the lead-in sole part is pivotally lowered onto the material to be sewn thereby partly releasing the pressure exerted by the sole plate and facilitating movement of the material to be sewn forwardly in the direction of sewing into the stitch formation region.

Another feature of the invention is that as a result of the pivotally mounted lead-in sole part, material to be sewn can be readily guided both in and transversely to the direction of sewing when oversewing cross seams. In a sewing machine having an edge trimming device this leads to a uniform spacing between a seam and the edge of the material.

Further features will become more fully apparent in the following description of the embodiments of this invention and from the appended claims.

DESCRIPTION OF THE PREFERRED EMBODIMENTS

Figure 1:
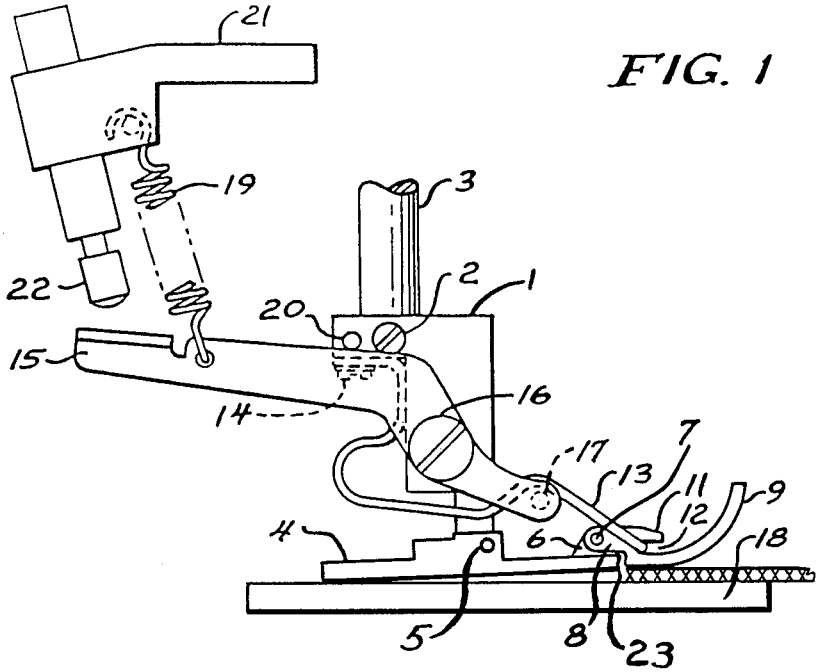
FIG. 1 is a fragmentary side elevational view of a presser foot assembly of the present invention, with a lead-in sole part lowered.
Figure 2:
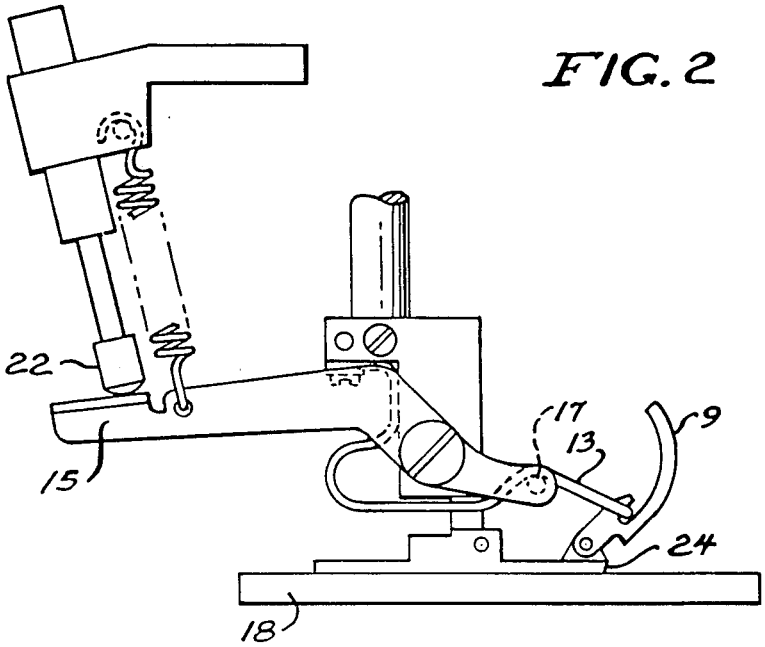
FIG. 2 is a fragmentary side elevational view of the presser foot assembly of FIG. 1 with the lead-in sole part pivotally lifted.

Referring now to FIGS. 1 and 2, there is shown a presser foot assembly of the present invention comprising a collar-like body 1 which is secured to a presser rod 3 by a screw 2. A sole plate 4 is mounted on the body 1 by a pin 5. A lead-in sole part 9 is pivotally mounted at the front of the sole plate 4 by a pin 7 which passes through a boss 6 on the upper side of the sole plate 4, and through side lugs 8 and 10 on the lead-in sole part 9. A projection 11 on the lead-in sole part 9 has a recess 12 to receive one end of a spring member or element 13 of which the other end is fastened to the body 1 by a screw 14.

One end of a lever 15 is pivoted to the body 1 by a screw 16, and carries a pin 17 which can be engaged under the spring 13. The spring 13 presses the lead-in sole part 9 against a workpiece support 18. A second spring 19 acts between a holder 21 and the lever 15, and can pull the lever 15 against a stop 20 on the body 1. The holder 21 carries a lever actuating push rod 22 which is directed towards the lever 15, and is responsive to actuating means, such as a compressed-air cylinder.

To insert the material to be sewn, the actuating means for the push rod 22 is actuated to lift the lead-in sole part 9 off the workpiece support 18. The push rod 22 presses on the free end of the lever 15, the pin 17 engages under the spring 13, and as a result the lead-in sole part 9 is moved upwardly to the position shown in FIG. 2.

When the lead-in sole part 9 is moved upwardly, a locating stop face 24 is revealed at the joint 23 between the sole plate 4 and the lead-in sole part 9. The material to be sewn is pushed forward in the direction of sewing until its leading edge engages the locating stop face 24, and its position can then be secured by the subsequent lowering of the lead-in sole part 9. When the lever 15 is released, the spring 13 urges the lead-in sole part 9 into contact with the material to be sewn, and also acts upwardly on the body 1 due to presence of material under the lead-in sole thereby releasing some of the pressure exerted by the sole plate 4 and facilitating movement of the material forwardly in the direction of sewing into the region of stitch formation.

Figure 3:
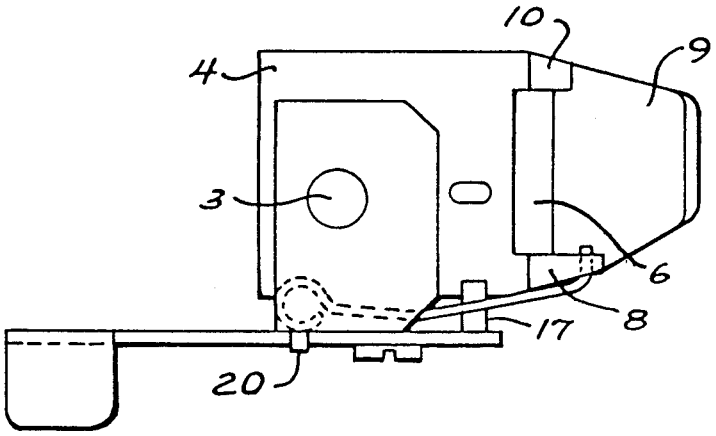
FIG. 3 is a plan view of a presser foot assembly according to FIGS. 1 and 2.

As shown in FIG. 3, the presser foot assembly FIGS. 1 and 2 comprises a sole plate 4 in one piece with an articulated lead-in sole part 9. As shown, the lead-in sole part 9 extends across substantially the whole width of the sole plate 4 at the pivotal connection.

Figure 4:
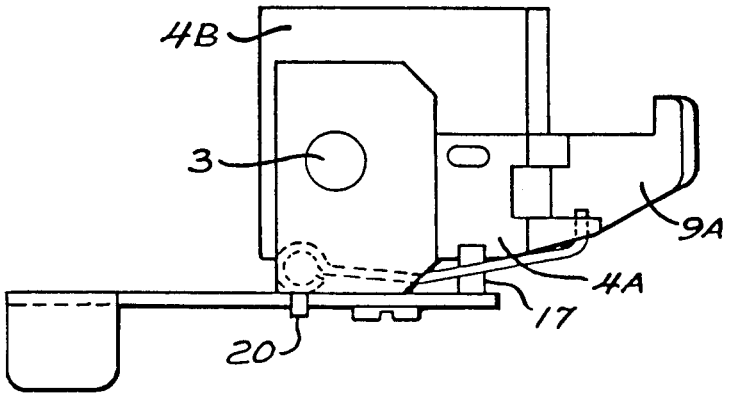
FIG. 4 is a plan view of a presser foot assembly of another embodiment of the present invention.

In another embodiment, as shown in FIG. 4, the sole plate comprises two parts 4A and 4B, and the lead-in sole part 9A is pivotally connected only to the sole plate part 4A.

The foregoing detailed description is given for clearness of understanding only, and no unnecessary limitations should be understood therefrom, as modifications will be obvious to those skilled in the art.

We claim:

1. A presser foot assembly for use with a workpiece support in a sewing machine, comprising:

a sole plate;

means for supporting the sole plate in a position for pressing material to be sewn onto a workpiece support;

a lead-in sole part;

means for pivotally connecting the lead-in sole part to the sole plate; and spring means for moving the lead-in sole part between a first position adjacent the workpiece support and a second position spaced from the workpiece support.

2. The assembly of claim 1 wherein the supporting means comprises a body secured to a presser rod.

3. The assembly of claim 1 wherein the sole plate includes a front face which extends transversely to the direction of sewing adjacent the lead-in sole part.

4. The assembly of claim 1 wherein the lead-in sole plate has a curved shape.

5. A presser foot assembly for use with a workpiece support in a sewing machine, comprising:

a sole plate;

means for supporting the sole plate in a position for pressing material to be sewn onto a workpiece support;

a lead-in sole part;

means for pivotally connecting the lead-in sole part to the sole plate; and means for moving the lead-in sole part between a first position adjacent the workpiece support and a second position spaced from the workpiece support, including means responsive to the moving means for releasing partial pressure of the sole plate when the lead-in sole part is located in the first position.

6. A presser foot assembly for use with a workpiece support in a sewing machine, comprising:

a sole plate;

means for supporting the sole plate in a position for pressing material to be sewn onto a workpiece support;

a lead-in sole part;

means for pivotally connecting the lead-in sole part to the sole plate; and means for moving the lead-in sole part between a first position adjacent the workpiece support and a second position spaced from the workpiece support, wherein the moving means comprises, a spring member connected between the lead-in sole part and the supporting means for urging the lead-in sole part to the first position, and means for lifting the spring member to move the lead-in sole part to the second position.

7. The assembly of claim 6 wherein the lifting means comprises a lever pivotally connected to the supporting means with a forward end of the lever located adjacent the spring member, means for urging the lever to a first position with the forward end lowered and releasing the spring member, and means for moving the lever to a second position with the forward end raised and lifting the spring member.

8. A presser foot assembly for sewing machines comprising a body secured to a presser rod, a sole plate connected to the body for pressing material to be sewn onto a workpiece support, a lead-in sole part pivotally connected to the sole plate, and a spring element adapted to urge the lead-in sole part towards the workpiece support including lever means for pivotally lifting the lead-in sole part relative to the sole plate against the force of the spring element.

9. The assembly of claim 8 wherein the sole plate has a front face which extends transversely to the direction of sewing and which is uncovered when the lead-in sole part is lifted and serves as a locating stop face for engagement by a leading edge of material to be sewn.

10. The assembly of claim 8 wherein one end of the spring element is clamped to the body and the other end of the spring element is pivotally connected to the lead-in sole part.

11. The assembly of claim 10 wherein the lifting means comprises lever means is pivotally mounted on the body and is adapted upon actuation to engage the spring element and displace it to thereby pivotally lift the lead-in sole part relative to the sole plate.

12. The assembly of claim 8 wherein the sole plate is divided longitudinally in the direction of sewing, and in which the lead-in sole part is pivotally connected to at least one part of the sole plate.

* * * * *